US005143635A

United States Patent [19]

Young et al.

[11] Patent Number: 5,143,635

[45] Date of Patent: Sep. 1, 1992

[54] HYDRAULIC DRAG REDUCING AGENTS FOR LOW TEMPERATURE APPLICATIONS

[75] Inventors: John C. O'C. Young; Christopher B. Murray, both of Halifax, Canada

[73] Assignee: Energy, Mines & Resources - Canada, Ottawa, Canada

[21] Appl. No.: 788,451

[22] Filed: Nov. 6, 1991

Related U.S. Application Data

[63] Continuation-in-part of Ser. No. 615,232, Nov. 19, 1990, abandoned.

[30] Foreign Application Priority Data

Feb. 2, 1990 [CA] Canada ..... 2009210

[51] Int. Cl.[5] ..... C10M 173/02

[52] U.S. Cl. ..... 252/34; 252/49.3; 137/13

[58] Field of Search ..... 252/34, 49.3, 356, 8.552, 252/8.554; 137/13

[56] References Cited

U.S. PATENT DOCUMENTS 4,615,825 10/1986 Teot ..... 252/34

FOREIGN PATENT DOCUMENTS 3827183 2/1990 Fed. Rep. of Germany .
1205721 9/1970 United Kingdom .

*Primary Examiner*—Prince Willis, Jr.
*Assistant Examiner*—Thomas Steinberg

[57] ABSTRACT

Heat exchange fluids have improved flow characteristics at low temperature by incorporation of specific surfactant drag reducing compositions. The drag reducing composition comprises (1) a quaternary ammonium surfactant and (2) a preferably stoichiometric or greater amount of an organic counterion. The counterion is preferably 2,6-dihydroxybenzoate which contains a negatively charged head group substituent and a hydroxyl group in both adjacent positions.

8 Claims, 1 Drawing Sheet

HYDRAULIC DRAG REDUCING AGENTS FOR LOW TEMPERATURE APPLICATIONS

CROSS-REFERENCE TO A RELATED APPLICATION

This application is a continuation-in-part of application Ser. No. 07/615,232, filed Nov. 19, 1990, now abandoned.

BACKGROUND OF THE INVENTION

This invention relates to a method for providing improved heat transfer fluids, particularly for use in low temperature environments.

The use of chemical additives as hydraulic drag reducing agents to increase liquid and slurry flows through pipelines has been widely studied. However, such studies make no reference to applications at temperatures appreciably below ambient, which are of great interest in space cooling and other refrigerative systems employing chilled water and ice slurry flows. For such applications, temperatures in the range of −5 to +15° C. are of particular interest. Compatibility with polyhydric alcohols and other solutes may also be required.

Ohlendorf et al, Canadian Patent No. 1,231,099, issued Jan. 5, 1988 describes the use of n-dodecyl(lauryl)-trimethylammonium salicylate as a drag reducing agent for temperatures in the range of 0°–30° C. at dosages of 5–25 mM. However, in attempts to reproduce the Ohlendorf work using 5–10 mM solutions in both water and 10% w/w ethylene glycol at temperatures from ambient to −5° C., the above additive was found to be reasonably effective in the range of +10° to +20° C., but was ineffective at lower temperatures. Transient supercooling was observed when these solutions were cooled to 5° C. and below, with the result that significant drag reduction was observed over several rheometer test cycles but precipitation eventually occurred and drag reduction ceased. It appears that the n-dodecyl(-lauryl)trimethylammonium salicylate has a Krafft point (minimum temperature at which the solubility of its monomeric form exceeds its critical micellar concentration value) of close to 5° C. A necessary but insufficient requirement for drag reducing capability is that the monomeric form of the additive be sufficiently soluble for its concentration in solution to reach the minimum level necessary for colloidal micelle formation, mainly the critical micellar concentration. A second requirement is that the additive should be capable of forming asymmetric, "rod-like" micelles.

Recognized drag reducing agents of the type represented by n-dodecyl(lauryl)trimethylammonium salicylate consists of two components, an n-alkyl trimethylammonium cationic surfactant and an anionic counterion which aids micelle formation by reducing electrostatic repulsion between neighbouring surfactant molecules in the micelle. As has been indicated above, the ability of these surface active compounds to act as hydraulic drag reducing agents is associated with their capacity to form asymmetric, rod-like colloidal micelles. Asymmetric micelle formation is achieved only over the temperature range between the Krafft point and the micellar transformation temperature for the given additive and dosage level.

Each of the two additive constituents, the surfactant and the counterion, must be chosen to ensure that the Krafft point of the additive pair lies below the lower limit of the desired operating temperature range. This requirement is relatively easy to meet for operating temperatures above ambient, but is not met by any of the additives thus far recommend in the literature when employed at temperatures close to and below the normal freezing point of water. For this below-ambient temperature range, the reduced solubility of the monomeric form of the additive greatly restricts the choice of candidate compounds.

The Krafft point of a given additive system is defined by the intersection between its monomer solubility vs. temperature relationship and the relationship between solution temperature and the minimum additive concentration necessary for micelle formation to occur (the cmc value). The Krafft point may be reduced by modifying the composition of the additive so as to raise its solubility and/or reduce its cmc value. However, in any given homologous series of additives, higher solubility is associated with higher cmc values.

Homologs of n-dodecyl(lauryl)triammonium salicylate containing longer alkyl chains are more amphiphilic, and therefore exhibit stronger micelle forming tendencies and hence lower cmc values. However, the higher homologs of n-dodecyl(lauryl)triammonium salicylate are less soluble in water, and findings of the present inventors indicate that the effect of lower solubility in elevating the Krafft point more than compensates for the effect of lower cmc values of depressing it. Thus, the net effect is an increase in Krafft point with increase in alkyl chain length.

Schmitt et al, U.K. Patent 1,205,721 describes viscosity reducing agents, including 2-, 3- and 4-hydroxybenzoic acids, 3,5-dihydroxybenzoic acid and a wide variety of other compounds. However, under turbulent flow conditions of practical interest, hydraulic drag is virtually independent of solution viscosity. Because drag reducers work by creating long-range order, it is frequently found that counterions which produce the largest increases in viscosity are also the most effective aids to drag reduction. The agents described by Schmitt are not suitable drag reducers, particularly at low temperatures.

Toet et al, U.S. Pat. No. 4,615,825 relates to friction reduction using a viscoelastic surfactant. It shows that the friction exhibited by an aqueous liquid containing an alkyl trimethylammonium surfactant is further reduced by adding o-hydroxybenzoate counterion. However, none of the agents described are useful as drag reducers at low temperatures.

It is the object of the present invention to find counterions which could be used with an n-alkyl trimethylammonium cationic surfactant which would aid micelle formation and so bring down the cmc value. The specific object of the invention is to reduce the Krafft point of the additive system to a target of close to or below the freezing point of water while maintaining a rod-to-sphere transformation temperature of at least 25° C. at a dosage level of 5 mM.

SUMMARY OF THE INVENTION

Accordingly, in one aspect, the present invention is a method for reducing the friction exhibited by a liquid passing at low temperatures through a conduit. This method comprises passing through a conduit a liquid containing a drag reducing agent comprising (1) a quaternary ammonium surfactant and (2) an organic counterion to provide effective drag reduction at temperatures close to or below the freezing point of water. The ratios of quaternary ammonium surfactant and organic counterions can be varied quite widely, but the organic counterion is preferably present in a stoichiometric or greater amount.

The method and composition of this invention are useful in processes where water or other liquids are pumped or circulated in pipes or other conduits such as in air-conditioner or other heat exchangers, slurry pipelines and other operations requiring large amounts of energy for pumping liquids.

In general, surfactant compounds comprise an ionic hydrophobic molecule having an ionic, hydrophilic, moiety chemically bonded to a hydrophobic moiety (herein called a surfactant ion) and a counterion sufficient to satisfy the charge of the surfactant ion. Examples of such surfactant compounds are represented by the formula:

$$R_1(Y^{\oplus})X^{\ominus}$$

or $$R_1(Z^{\ominus})A^{\oplus}$$

wherein $R_1(Y^{\oplus})$ and $R_1(Z^{\ominus})$ represent surfactant ions having a hydrophobic moiety represented by $R_1$ and an ionic, solubilizing moiety represented by the cationic moiety ($Y^{\oplus}$) or the anionic moiety ($Z^{\ominus}$) chemically bonded thereto. $X^{63}$ and $A^{63}$ are the counterions associated with the surfactant ions.

In general, the hydrophobic moiety (i.e., $R_1$) of the surfactant ion is hydrocarbyl or inertly substituted hydrocarbyl wherein the term "inertly substituted" refers to hydrocarbyl radicals having one or more substituents groups, e.g., halo groups such as —Cl or —Br, or chain linkages, such as a silicon linkage (—Si—) which are inert to the aqueous liquid and components contained therein. Typically, the hydrocarbyl radical is an aralkyl group or a long chain alkyl or inertly substituted alkyl, which alkyl groups are generally linear and have at least 12, advantageously at least 16, carbon atoms. Representative long chain alkyl groups include dodecyl (lauryl), tetradecyl (myristyl), hexadecyl (cetyl), octadecyl (stearyl) and the derivatives of tallow, coco and soya. Preferred alkyl groups are generally alkyl groups having from 14 to 24 carbon atoms, with octadecyl, hexadecyl, eurcyl and tetradecyl being the most preferred.

The cationic, hydrophilic moieties (groups), i.e., ($Y^{\oplus}$), are typically onium ions wherein the term "onium ions" refers to a cationic group which is essentially completely ionized in water over a wide range of pH, e.g., pH values from 2 to 12. Representative onium ions include quaternary ammonium groups, i.e., $-N^{\oplus}(R)_3$; tertiary sulfonium groups, i.e., $-S^{\oplus}(R)_2$; and quaternary phosphonium groups, i.e., $-P^{61}(R)_3$ wherein each R is individually a hydrocarbyl or inertly substituted hydrocarbyl. In addition, primary, secondary and tertiary amines, i.e., $-NH_2$, —NHR or $-N(R)_2$, can also be employed as the ionic moiety if the pH of the aqueous liquid being used is such that the amine moieties will exist in ionic form. Of such cationic groups, the surfactant ion of the viscoelastic surfactant is preferably prepared having quaternary ammonium, $-N^{61}(R)_3$, or tertiary amine, $-N(R)_2$, groups wherein each R is independently an alkyl group or hydroxyalkyl group having from 1 to 4 carbon atoms, with each R preferably being methyl, ethyl or hydroxyethyl.

Representative anionic, solubilizing moieties (groups) ($Z^{\ominus}$) include sulfate groups, i.e. $-OSO_3^{\ominus}$, sulfonate groups, i.e., $-SO_3^{\ominus}$, carboxylate groups, i.e., $-COO^{\ominus}$, phosphonate groups, and phosphonite groups. Of such anionic groups, the surfactant ion of the viscoelastic surfactants is preferably prepared having a carboxylate or sulfate group. For purposes of this invention, such anionic solubilizing moieties are less preferred then cationic moieties.

The counterions (i.e., $X^{\ominus}$or $A^{\oplus}$) associated with the surfactant ions are suitably ionically charged, organic materials having ionic character opposite that of the surfactant ion, which combination of counterion and surfactant ion imparts viscoelastic properties to an aqueous liquid. The organic material having an anionic character serves as a counterion for a surfactant ion having a cationic, hydrophilic moiety and the organic material having a cationic character serves as the counterion for the surfactant ion having an anionic, hydrophilic moiety.

The counterions useful according to this invention are quite specific and are preferably benzoates, although naphthalates, carboxylates or sulfonates may be used. These contain a negatively charged head group substituent and an electron withdrawing or delocalizing group in both adjacent positions. These electron withdrawing or delocalizing groups are preferably hydroxyl groups. It has also been found advantageous for such counterions to contain an alkyl substituent to enhance amphiphilic character.

A particularly preferred counterion has been found to be 2,6-dihydroxybenzoate and this is preferably used in combination with alkyltrimethylammonium cations in which the alkyl group contain more than 10 carbon atoms and whose length is matched to the desired operating temperature range. This alkyl group may be unsaturated and/or ethoxylated and other short alkyl, alkenyl or alkoxy groups may be substituted for one or more of the three methyl groups. A particularly preferred alkyltri-methylammonium cation is a n-dodecyltrimethyl ammonium cation, e.g. in the chloride, bromide or hydroxide form.

BRIEF DESCRIPTION OF THE DRAWINGS

The benefits of this invention are illustrated by the attached FIG. 1, which is a plot of friction factor as a function of Reynold's No. for several materials.

DESCRIPTION OF THE PREFERRED EMBODIMENTS

Figure 1:
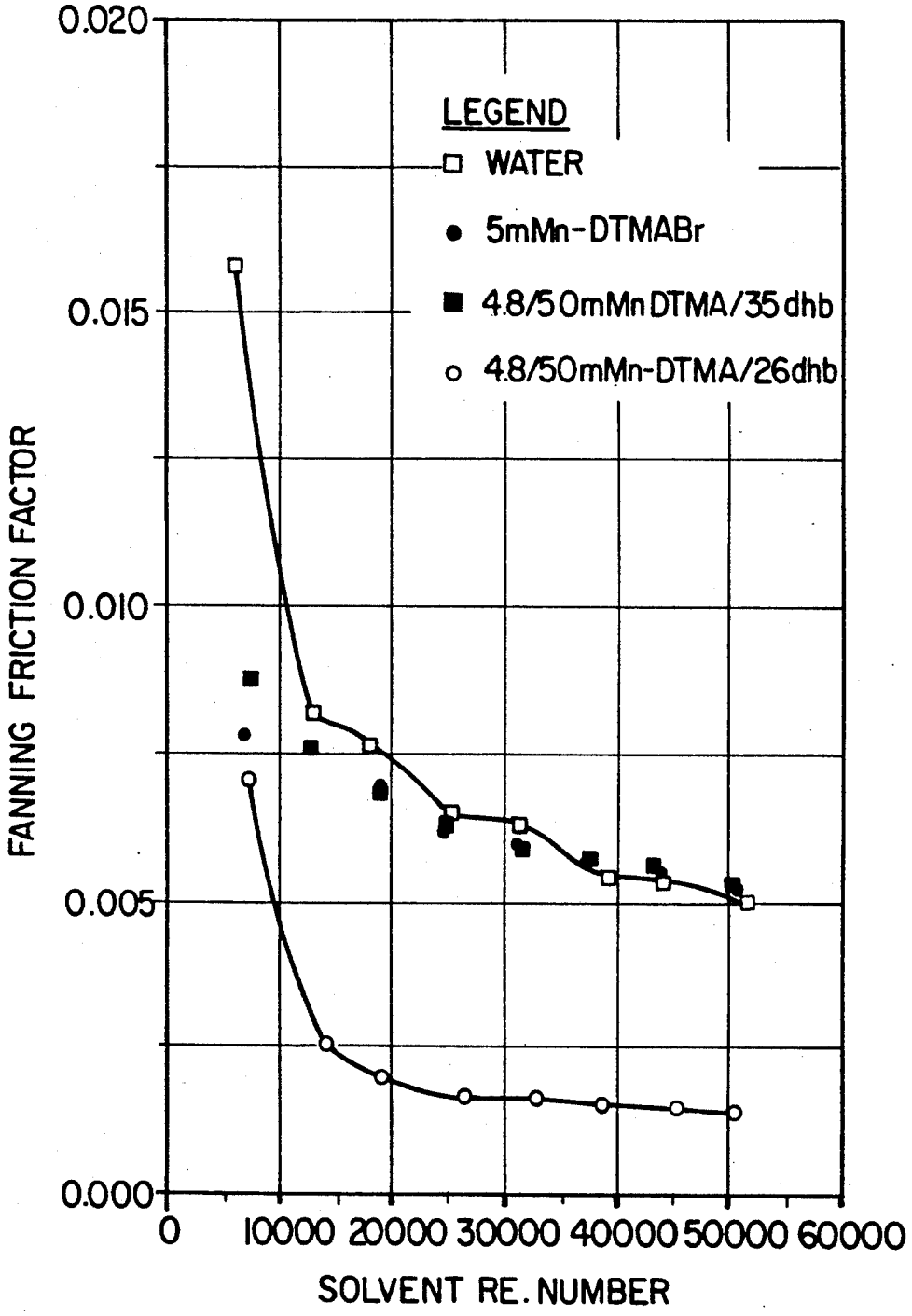

The following examples are presented to illustrate the invention and should not be construed to limit its scope. All percentages and parts are by weight unless otherwise indicated.

EXAMPLE 1

A series of drag reducing agents were prepared from 10 mM solutions of n-dodecyltrimethylammonium chloride in 10% w/w ethylene glycol, to which were added equimolar amounts of various counterions. These were mixed together at 60° C. and then left on a shelf for several days.

The drag reducing agents thus formed were then tested for drag-reducing capabilities at different temperatures using a turbulent flow rheometer. The counterions used, the test temperatures and the % drag reduction obtained are shown in the following Table I:

TABLE I

| Counterion | °C. | % Drag Reduction | Comments |
|---|---|---|---|
| 3-methylsalicylate | 10 | 66 | stable to above Re = 12,000 |
| 2,6-dihydroxybenzoate | 10 | 65 | stable to above Re = 16,000 |
| 2,6-dihydroxybenzoate | −2 | 64 | stable to above Re = 12,000 |
| salicylate | 10 | 64 | precipitates at 7° C. |
| 4-methylsalicylate | 2 | 63 | stable to above Re = 12,000 |
| 1,4-dihydroxy-2-naphthoate | 7 | 54 | stable to above Re = 12,000 |
| 2-hydroxy-1-naphthoate | 7 | 48 | only stable to Re = 6,000 |
| 4-methylbenzoate | 2 | 9 | |
| 4-methylsulfonate | 10 | 4 | |
| 4-hydroxybenzoate | 5 | −2 | |
| 2,3-dihydroxybenzoate | 10 | −3 | precipitation of additive |
| 1-hydroxy-2-naphthoate | 10 | −3 | precipitation of additive |

From the above table it will be seen that the 2-hydroxybenzoate (salicylate) and 2,6-dihydroxybenzoate show similar drag reducing performances at 10° C., but the 2-hydroxybenzoate (salicylate) precipitates and drag reduction is lost at 7° C. and below. The 3-methylsalicylate and 2,6-dihydroxybenzoate show similar drag reducing performances at 10° C. but the 3-methylsalicylate shows lower shear resistance. This lower shear resistance is associated with poor thermal stability.

The importance of amphiphilic character is shown by the fact that introduction of a hydrophilic hydroxyl group at the para position in salicylate (producing 2,4-dihydroxybenzoate) completely destroyed its drag reducing capability. This supports applicants understanding that, to be effective, a counterion must insert itself into the body of the micelle.

Amphiphilic character and the location of electron withdrawing substituents in the positions adjacent to the counterion head group are both important. 4-hydroxybenzoate is ineffective as a counterion because it lacks both of these features. 4-methylbenzoate possesses a measure of amphiphilic character, but is ineffective because it lacks an electron withdrawing substituent in either position adjacent to the carboxyl head group.

EXAMPLE 2

Following the same general procedure as in Example 1, comparative drag reduction data was obtained for 3,5-dihydroxybenzoate and 2,6-dihydroxybenzoate. These were mixed with 5 mM solutions of n-dodecyltrimethylammonium bromide in equimolar amounts.

The drag reducing agents thus formed were then tested for drag-reducing capabilities along with the n-dodecyltrimethylammonium bromide itself and with water. The tests were conducted at 13° C. and pH 6–7 and the same turbulent flow conditions, using a turbulent flow rheometer for measuring. The results obtained are shown in FIG. 1.

It will be seen that solutions of n-dodecyltrimethylammonium bromide with and without 3,5-dihydroxybenzoate exhibits similar drag to that of water under the same turbulent flow conditions. On the other hand, the 2,6-dihydroxybenzoate shows in comparison a substantial drag reduction. At an intermediate solvent Reynolds Number (Re) of 30,000, the 2,6-dihydroxybenzoate produced approximately 70% drag reduction.

The test were conducted at 13° C. because lower temperatures cause the n-dodeoyltrimethylammonium bromide and n-dodecyltrimethylammonium bromide containing 3,5-dihydroxybenzoate to precipitate out.

In considering the above results, it will be noted that an amphiphilic anion is required to enhance micellation of quaternary ammonium cations to the extent necessary to make them effective as drag reducers. Many workers, including Toet in U.S. Pat. No. 4,615,825, have shown that simple aromatic acid anions, such as carboxylates and sulfonates, have this capability to promote micellation and thereby to enormously increase the viscosity of the solution. They have found that their effectiveness in the role is enhanced by introducing an electron-withdrawing substituent, generally an hydroxyl group, in the ring position immediately adjacent that occupied by the negatively charged head group. This substitution into benzoate produces salicylate, which is undoubtedly the most widely studied counterion and a logical bench mark against which to judge the effectiveness of other counterions. It is believed that the hydroxyl group attracts and thereby disperses the negative charge on the head group, making it more effective for neutralizing the positive charges on adjacent quaternary ammonium cations and thus drawing these cations closer together in the micelle. It is furthermore believed that the benzene ring of the counterion lies within the hydrophobic core region of the micelle between the radially oriented alkyl "tails" of the cation. This serves to explain why 2-hydroxybenzoate is an effective counterion while 3-, 4- and 5-hydroxybenzoates are not. Not only do these three latter structures lack electron-withdrawing capability, but each also would introduce a hydrophilic group into the hydrophobic core region of the micelle.

It has been shown in the present invention that 2,6-dihydroxybenzoate is the most effective of the dihydroxybenzoates and it is believed that this is because both hydroxyl groups are in electron-withdrawing positions and both would necessarily be located near the surface of the micelle. Conversely, 3,5-dihydroxybenzoate, which has been shown to be ineffective, constitutes the worst possible arrangement with two non-adjacent repulsive hydrophilic groups and no electron-withdrawing capability.

Although the present invention has been demonstrated with specific drag reducing compositions, it is apparent that obvious changes in the drag reducing compositions can be contemplated by one skilled in the art and such variations are deemed to be within the scope of the present invention as claimed in the following claims.

We claim:

1. A method for reducing friction exhibited by a liquid passing through a conduit which comprises passing through a conduit an a aneous liquid containing a drag reducing agent comprising (1) an alkyl trimethylammonium surfactant, in which the alkyl group contains more than ten carbon atoms and (2) an organic counterion comprising 2,6-dihydroxybenzoate to provide effective drag reduction at sub-ambient temperatures close to or below the freezing point of water.

2. A method according to claim 1 wherein the quaternary ammonium surfactant is a n-dodecyltrimethylammonium cationic surfactant.

3. A method according to claim 2 wherein the quaternary ammonium surfactant is n-dodecyltrimethylammonium chloride or bromide.

4. A method according to claim 1 wherein the organic counterion is present in a stoichiometric or greater amount.

5. A drag reducing composition for use in reducing friction exhibited by an aaueous liquid passing through a conduit at sub-ambient temperatures close to or below the freezing point of water, said composition comprising: (1)an alkyl trimethylammonium surfactant, in which the alkyl group contains more than ten carbon atoms and (2) an organic counterion comprising 2,6-dihydroxybenzoate to provide effective drag reduction at sub-ambient temperatures close to or below the freezing point of water.

6. A composition according to claim 5 wherein the quaternary ammonium surfactant is a n-dodecyltrimethylammonium cationic surfactant.

7. A composition according to claim 6 wherein the quaternary ammonium surfactant is n-dodecyltrimethylammonium chloride or bromide.

8. A composition according to claim 5 wherein the organic counterion is present in a stoichiometric or greater amount.

* * * * *